US010662619B2

(12) United States Patent
Sakamoto

(10) Patent No.: US 10,662,619 B2
(45) Date of Patent: May 26, 2020

(54) HYDRAULIC APPARATUS

(71) Applicant: Yanmar Co., Ltd., Osaka-shi, Osaka-fu (JP)

(72) Inventor: Kunihiko Sakamoto, Chikugo (JP)

(73) Assignee: YANMAR CO., LTD., Osaka (JP)

( * ) Notice: Subject to any disclaimer, the term of this patent is extended or adjusted under 35 U.S.C. 154(b) by 28 days.

(21) Appl. No.: 15/739,457

(22) PCT Filed: Jun. 2, 2016

(86) PCT No.: PCT/JP2016/066398
§ 371 (c)(1),
(2) Date: Dec. 22, 2017

(87) PCT Pub. No.: WO2016/208349
PCT Pub. Date: Dec. 29, 2016

(65) Prior Publication Data

US 2018/0187396 A1 Jul. 5, 2018

(30) Foreign Application Priority Data

Jun. 25, 2015 (JP) ..... 2015-127316

(51) Int. Cl.
*E02F 9/22* (2006.01)
*F15B 11/17* (2006.01)
(Continued)

(52) U.S. Cl.
CPC ..... *E02F 9/2225* (2013.01); *E02F 9/2267* (2013.01); *E02F 9/2271* (2013.01);
(Continued)

(58) Field of Classification Search
CPC ... E02F 9/2239; F15B 11/042; F15B 11/0426; F15B 11/17
See application file for complete search history.

(56) References Cited

U.S. PATENT DOCUMENTS 4,561,824 A * 12/1985 Okabe ..... E02F 9/2239 414/697
2014/0060025 A1* 3/2014 Cesur ..... F15B 21/08 60/327
(Continued)

FOREIGN PATENT DOCUMENTS

CN 1341185 A 3/2002
CN 101270766 A 9/2008
(Continued)

OTHER PUBLICATIONS

International Search Report dated Aug. 23, 2016 issued in corresponding PCT Application PCT/US2016/066398.
(Continued)

*Primary Examiner* — F Daniel Lopez
*Assistant Examiner* — Matthew Wiblin
(74) *Attorney, Agent, or Firm* — Norton Rose Fulbright US LLP

(57) ABSTRACT

A hydraulic apparatus for a hydraulic work vehicle capable of supplying pressure oil to any of a bucket cylinder, an arm cylinder, a boom cylinder, a swing cylinder, a blade cylinder, a turning hydraulic motor, a left traveling hydraulic motor, a right traveling hydraulic motor, and a PTO hydraulic motor by a first hydraulic pump, a second hydraulic pump, or a third hydraulic pump. The pressure oil can be branched off from a discharge oil passage of the third hydraulic pump and supplied through an external pipe to a downstream side of a load check valve disposed on an oil passage communicating with a pump port of a PTO control valve for switching supply of pressure oil from the second hydraulic pump to an external hydraulic work machine.

19 Claims, 5 Drawing Sheets

(51) Int. Cl.
*F15B 11/042* (2006.01)
*F15B 13/02* (2006.01)

(52) U.S. Cl.
CPC ..... *F15B 11/0426* (2013.01); *F15B 11/17* (2013.01); *F15B 13/027* (2013.01); *F15B 2211/20576* (2013.01)

(56) References Cited

U.S. PATENT DOCUMENTS

| | | | | |
|---|---|---|---|---|
| 2014/0283676 | A1* | 9/2014 | Beschorner ..... | F15B 11/17 91/418 |
| 2016/0138619 | A1* | 5/2016 | Zhang ..... | F15B 11/17 60/327 |

FOREIGN PATENT DOCUMENTS

| | | | | |
|---|---|---|---|---|
| EP | 0715029 | A1 | 6/1996 | |
| EP | 0927794 | A1 | 7/1999 | |
| JP | 63233127 | A * | 9/1988 | ..... E02F 9/2239 |
| JP | H01-065401 | U1 | 4/1989 | |
| JP | H02-248706 | A | 10/1990 | |
| JP | 10-088627 | A | 4/1998 | |
| JP | 2000-154605 | A | 6/2000 | |
| JP | 2000-154805 | A | 6/2000 | |
| JP | 2002-276609 | A | 9/2002 | |
| WO | 9812391 | A1 | 3/1998 | |
| WO | 2014/086569 | A1 | 6/2014 | |

OTHER PUBLICATIONS

Japanese Office Action dated Jun. 4, 2019 issued in corresponding Japanese Application 2015-127316.

European Search Report dated May 29, 2018 issued in corresponding European Application 16814120.8.

Chinese Office Action dated Jan. 22, 2019 issued in corresponding Chinese Application 201680023346.0.

European Search Report dated May 29, 2018 issued in corresponding EP Application 16814120.8 cites the foreign patent documents above.

* cited by examiner

HYDRAULIC APPARATUS

CROSS REFERENCES TO RELATED APPLICATIONS

This application is a national stage application pursuant to 35 U.S.C. § 371 of International Application No. PCT/JP2016/066398, filed on Jun. 2, 2016, which claims priority under 35 U.S.C. § 119 to Japanese Patent Application No. 2015-127316, filed on Jun. 25, 2015, the disclosures of which are hereby incorporated by reference in their entireties.

TECHNICAL FIELD

The present invention relates to a hydraulic apparatus for a hydraulic work vehicle, and particularly to a technique for a hydraulic apparatus including at least two hydraulic pumps and, while pressure oil is supplied to a PTO (external hydraulic work machine) by using these two hydraulic pumps, the hydraulic apparatus can prevent an extreme decrease of supply of hydraulic oil to the PTO when another hydraulic equipment is operated.

BACKGROUND ART

In a conventional hydraulic circuit for a turning excavator that supplies pressure oil to hydraulic actuators for driving a boom, an arm, and a bucket and for turning an excavator body by using first, second, and third hydraulic pumps, when each of the hydraulic actuators is driven individually, a known technique of a configuration is to supply pressure oil to each of the hydraulic actuators by using the first and third hydraulic pumps in driving the boom, by using the second and third hydraulic pumps in driving the arm, by using the first hydraulic pump in driving the bucket, and by using the third hydraulic pump in turning the excavator body (see, for example, PTL 1).

CITATION LIST

Patent Literature

PTL 1: Japanese Patent Application Laid-Open No. 10-88627

SUMMARY OF INVENTION

Technical Problem

In the technique of PTL 1, in an operation with the external hydraulic work machine attached, a previously set PTO port for external extraction is supplied with pressure oil from the second hydraulic pump and the third hydraulic pump. In this case, in a situation where a grass mower having a large flow rate of hydraulic oil in work is attached as the external hydraulic work machine for work, when a turning operation is performed during mowing, the total amount of pressure oil from the third hydraulic pump in the two of the hydraulic pumps is used for the turning operation. At this time, if a load in turning and a load on the PTO are high, torque control of a variable pump extremely reduces the flow rate of the second hydraulic pump, and the amount of oil supply to the PTO (external hydraulic work machine) decreases accordingly, resulting in a decrease in the number of rotations. That is, when a turning operation is performed during mowing, the rotation speed of the external hydraulic work machine decreases so that grass is easily entangled in a rotational shaft. When grass is entangled in the shaft, a load increases so that the pressure of hydraulic oil increases accordingly to cause a relief valve to operate, and the machine is stopped in some cases.

To prevent this, the hydraulic circuit is improved to maintain an appropriate number of rotations of the external hydraulic work machine when the external hydraulic work machine is turned during a turning operation of the machine.

Solution to Problem

A hydraulic apparatus according to an aspect of the present invention is a hydraulic apparatus for a hydraulic work vehicle including an external hydraulic work machine, and includes: a plurality of hydraulic pumps; a plurality of hydraulic actuators that are supplied with pressure oil from the plurality of hydraulic pumps; an external hydraulic actuator that is one of the plurality of hydraulic actuators and actuates the external hydraulic work machine; a control valve that switches oil supply from a first hydraulic pump of the plurality of hydraulic pumps to the external hydraulic actuator; a first load check valve disposed at an input side of the control valve on an oil passage from the first hydraulic pump toward the external hydraulic actuator through the control valve; and a pipe connecting a discharge side of a second hydraulic pump of the plurality of hydraulic pumps to a downstream side of the first load check valve.

In the hydraulic apparatus according to the aspect of the present invention, a second load check valve is preferably disposed on the pipe.

In the hydraulic apparatus according to the aspect of the present invention, a throttle is preferably disposed on the pipe.

In the hydraulic apparatus according to the aspect of the present invention, it is preferable that the first load check valve is disposed on an oil passage formed in a valve case of the control valve and is attached to the valve case with a holding plug, and the holding plug is configured as a joint in order to introduce an oil pressure from outside.

In the hydraulic apparatus according to the aspect of the present invention, a channel is preferably formed in a valve body of the first load check valve.

In the hydraulic apparatus according to the aspect of the present invention, a second load check valve is preferably integrally formed with the holding plug.

In the hydraulic apparatus according to the aspect of the present invention, a stop valve is preferably disposed on the pipe.

In the hydraulic apparatus according to the aspect of the present invention, the pipe is preferably provided with a direction control valve that selects the first hydraulic pump or the second hydraulic pump of the plurality of hydraulic pumps and allows the selected hydraulic pump to communicate with the pipe.

In the hydraulic apparatus according to the aspect of the present invention, the pipe is preferably provided with a shuttle valve that selects the first hydraulic pump or the second hydraulic pump of the plurality of hydraulic pumps and allows the selected hydraulic pump to communicate with the pipe.

Advantageous Effects of Invention

The present invention has advantages as follows.

The hydraulic apparatus for branching an optimum flow rate of hydraulic oil necessary for operating an external hydraulic work machine and turning a body can be reduced in size, and this hydraulic oil apparatus can be subsequently attached. An operation of the hydraulic apparatus can be stabilized independently of a working method of the external hydraulic work machine and hydraulic actuators of the body.

DESCRIPTION OF EMBODIMENTS

Figure 1:
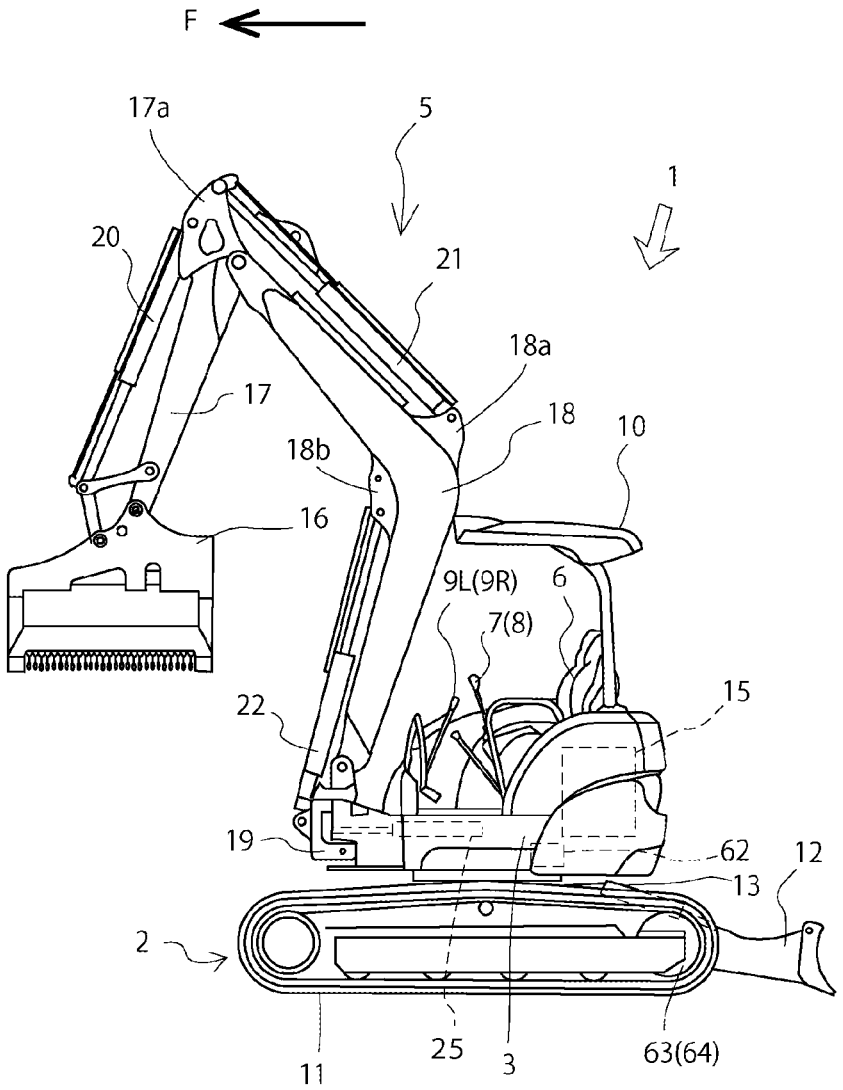
FIG. 1 A side view illustrating an entire configuration of a hydraulic work vehicle including a hydraulic circuit according to an aspect of the present invention.
Figure 2:
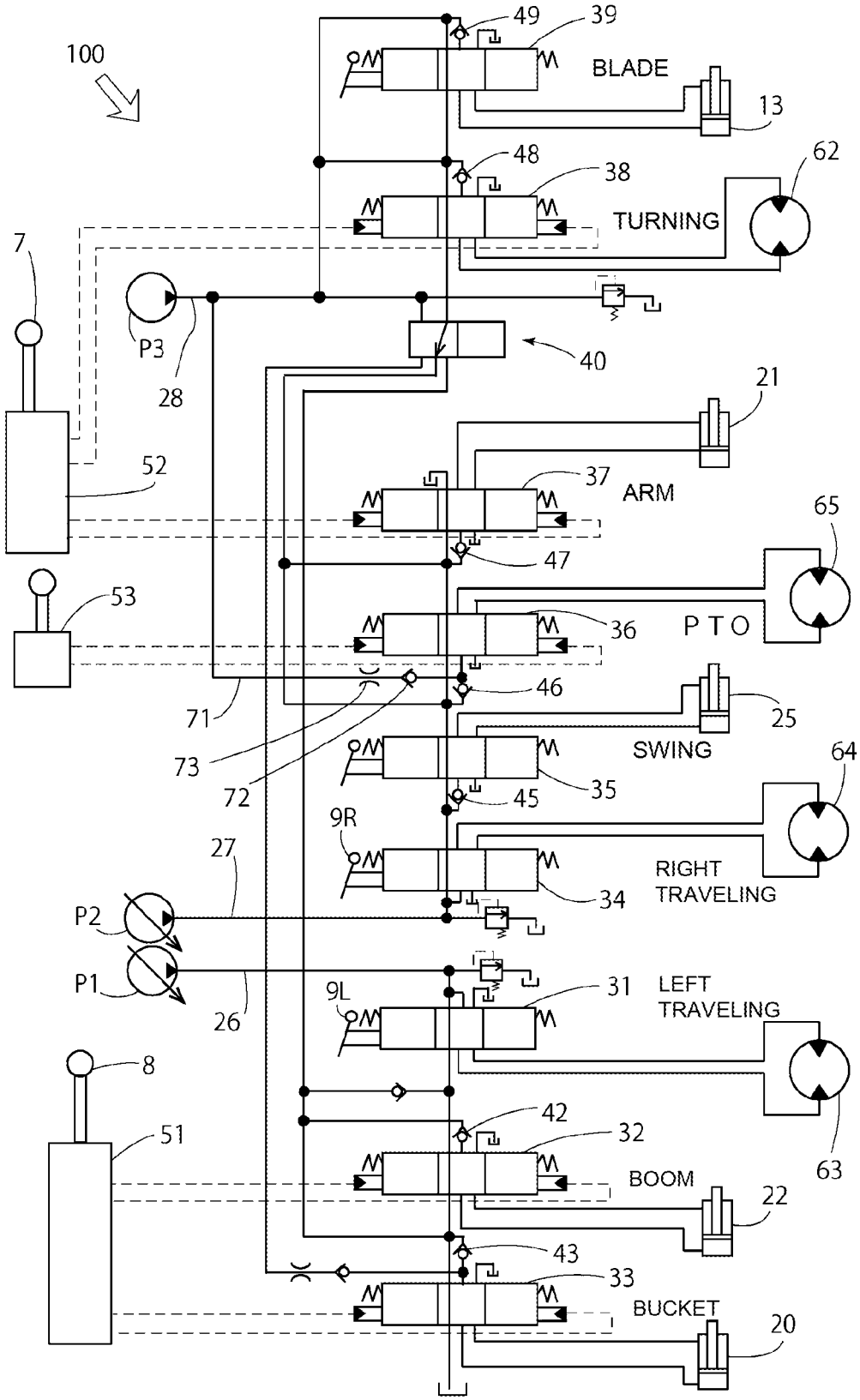
FIG. 2 A hydraulic circuit diagram of the hydraulic work vehicle.

Description will be given on an entire configuration of a backhoe 1 that is an example of a hydraulic work vehicle including a hydraulic apparatus according to an aspect of the present invention with reference to FIGS. 1 and 2. In FIG. 1, the direction indicated by arrow F is forward.

As illustrated in FIG. 1, the backhoe 1 mainly includes a crawler-type travelling device 2, a turning frame 3, and a working unit 5, for example.

The crawler-type travelling device 2 is a member constituting a lower structure of the backhoe 1, and includes a pair of left and right crawlers 11 and 11 each of which is wound around a drive wheel and a driven wheel. The crawler-type travelling device 2 also includes a blade 12 disposed rearward of a lateral center of a truck frame supporting the drive wheel and the driven wheel and a blade cylinder 13 that is a hydraulic cylinder for rotating the blade 12 vertically. The drive wheel is driven by a left traveling hydraulic motor 63 and a right traveling hydraulic motor 64 attached to the truck frame.

The turning frame 3 is a member constituting an upper structure of the backhoe 1, and is rotatably attached to an upper portion of the crawler-type travelling device 2 through a turning bearing from a longitudinal and lateral center of the truck frame. A turning hydraulic motor 62 is attached onto the turning frame 3. A turning drive gear fixed to an output shaft of the turning hydraulic motor 62 is meshed with a ring gear fixed to the truck frame. By rotating the turning hydraulic motor 62, the turning frame 3 can be turned laterally.

On a rear portion of the turning frame 3, an engine 15 serving as a driving source and first through third hydraulic pumps P1, P2, and P3 driven by the engine 15 are disposed. An upper portion of the turning frame 3 is used as an operation unit in such a manner that a seat 6 is disposed above the engine 1, work operating levers 7 and 8 are disposed at the left and right of the seat 6, and traveling levers 9L and 9R are disposed in front of the seat 6, for example. The operation unit is covered with a canopy 10 disposed above the operation unit. A boom bracket 19 for attaching the working unit 5 is disposed on a front portion at the lateral center of the turning frame 3.

The working unit 5 mainly includes an arm 17, a boom 18, a boom bracket 19, an external hydraulic work machine 16 serving as a PTO hydraulic actuator, a bucket cylinder 20, an arm cylinder 21, a boom cylinder 22, and a swing cylinder 25, for example, and is disposed on a front portion of the turning frame 3 of the backhoe 1.

The external hydraulic work machine 16 is attached instead of a bucket that is generally attached, and is a grass mower in this embodiment. As another example of the external hydraulic work machine 16, a drill or a gripper, for example, may be attached. In the grass mower as the external hydraulic work machine 16, cutting blades are driven to rotate by operation of the PTO hydraulic motor 65.

The external hydraulic work machine 16 is attached to the distal end of the arm 17, and the proximal end of the arm 17 is pivotally provided to the distal end of the boom 18 so that the arm 17 can rotate vertically.

The boom 18 is bent at an intermediate portion thereof toward the front of the machine, and has a proximal portion pivotally provided to the boom bracket 19 so that the boom 18 can rotate longitudinally.

The boom bracket 19 is a member constituting a base of the working unit 5, and has a rear end pivotally provided to the front end of the turning frame 3 so that the boom bracket 19 can rotate laterally.

The bucket cylinder 20 is a hydraulic cylinder for causing the external hydraulic work machine 16 to rotate longitudinally relative to the arm 17.

The bucket cylinder 20 has a cylinder end pivotally provided to a bracket 17*a* disposed on the proximal portion of the arm 17. The bucket cylinder 20 has a rod end pivotally provided to the external hydraulic work machine 16 through a link so that the bucket cylinder 20 can rotate. In this manner, the mowing angle of the grass mower can be adjusted to the ground.

The arm cylinder 21 is a hydraulic cylinder for causing the arm 17 to rotate relative to the boom 18.

The arm cylinder 21 has a cylinder end pivotally provided to a bracket 18*a* disposed on the upper surface of an intermediate portion of the boom 18 so that the arm cylinder 21 can rotate. The arm cylinder 21 also has a rod end pivotally provided to the bracket 17*a* so that the arm cylinder 21 can rotate.

The boom cylinder 22 is a hydraulic cylinder for rotating the boom 18.

The boom cylinder 22 has a cylinder end pivotally provided to the front end of the boom bracket 19 so that the boom cylinder 22 can rotate. The boom cylinder 22 also has a rod end pivotally provided to a bracket 18*b* disposed on the front surface of an intermediate portion of the boom 18 so that the boom cylinder 22 can rotate.

The swing cylinder 25 is a hydraulic cylinder for causing the boom 18 to rotate laterally relative to the turning frame 3. The swing cylinder 25 is interposed between the boom bracket 19 and the turning frame 3.

Next, description will be given on a configuration of a hydraulic circuit 100 as an example of a hydraulic circuit according to an aspect of the present invention with reference to FIG. 2.

The hydraulic circuit 100 is driven with supply of pressure oil discharged through the control valves from the first hydraulic pump P1, the second hydraulic pump P2, and the third hydraulic pump P3 that are driven by the engine 15.

A hydraulic circuit is formed from the first hydraulic pump P1 to enable oil supply from a discharge oil passage 26 to the left traveling hydraulic motor 63 through a left traveling control valve 31, to the boom cylinder 22 through a boom control valve 32, to the bucket cylinder 20 through a bucket control valve 33. An oil supply passage to a bridge passage of the boom control valve 32 is provided with a load check valve 42. An oil supply passage to a bridge passage of the bucket control valve 33 is provided with a load check valve 43.

A hydraulic circuit is formed from the second hydraulic pump P2 to enable oil supply from the discharge oil passage 27 to the right traveling hydraulic motor 64 through a right traveling control valve 34, to the swing cylinder 25 through a swing control valve 35, to the PTO hydraulic motor 65 through a PTO control valve 36, and to the arm cylinder 21 through an arm control valve 37. An oil supply passage to a bridge passage of the swing control valve 35 is provided with a load check valve 45. An oil supply passage to a bridge passage of the PTO control valve 36 is provided with a load check valve 46 serving as a first load check valve. An oil supply passage to a bridge passage of the arm control valve 37 is provided with a load check valve 47.

A hydraulic circuit is formed from the third hydraulic pump P3 to enable oil supply from a discharge oil passage 28 to the turning hydraulic motor 62 through a turning control valve 38 and to the blade cylinder 13 through a blade control valve 39. An oil supply passage to a bridge passage of the turning control valve 38 is provided with a load check valve 48. An oil supply passage to a bridge passage of the blade control valve 39 is provided with a load check valve 49.

The left traveling control valve 31 is switched by rotation of the traveling lever 9L so that the left traveling hydraulic motor 63 can rotate forward or backward. The right traveling control valve 34 is switched by rotation of the traveling lever 9R so that the right traveling hydraulic motor 64 can rotate forward or backward. In this manner, forward movement, backward movement, and lateral steering of the backhoe 1 can be performed.

When the work operating lever 8 of the operation unit is operated to rotate longitudinally, a right remote control valve 51 is switched so that a pilot oil pressure is supplied to a control unit of the boom control valve 32, and thereby, the boom cylinder 22 is extended and contracted to enable rotation of the boom 18.

When the work operating lever 8 of the operation unit is rotated laterally, the right remote control valve 51 is switched so that a pilot oil pressure is supplied to a control unit of the bucket control valve 33 for switching, and thereby, the bucket cylinder 20 is extended and contracted to enable rotation of the external hydraulic work machine (bucket) 16.

When the work operating lever 7 of the operation unit is rotated longitudinally, a left remote control valve 52 is switched so that a pilot oil pressure is supplied to a control unit of the arm control valve 37 for switching, and thereby, the arm cylinder 21 is extended and contracted to enable rotation of the arm 17.

When the work operating lever 7 of the operation unit is operated laterally, the left remote control valve 52 is switched so that a pilot oil pressure is supplied to a control unit of the turning control valve 38 for switching, and thereby, the turning hydraulic motor 62 is rotated to enable turning of the turning frame 3.

The boom control valve 32, the bucket control valve 33, the arm control valve 37, and the turning control valve 38 may be solenoid valves, and the right remote control valve 51 and the left remote control valve 52 may be replaced by switches to be electrically switched.

Each of the swing control valve 35 and the blade control valve 39 can be switched by operating an unillustrated operation pedal or an unillustrated operation lever.

The discharge oil passage 28 of the third hydraulic pump P3 is provided with a merging hydraulic circuit 40 for the bucket cylinder 20, the boom cylinder 22, the arm cylinder 21, and the PTO hydraulic motor 65. In raising the boom cylinder 22 by single driving, pressure oil from the first hydraulic pump P1 and pressure oil from the third hydraulic pump P3 are merged together, and the merged pressure oil is supplied to the boom cylinder 22 or the bucket cylinder 20 so that the amount of pressure oil is increased to speed up a raising operation of the boom 18. In driving the PTO hydraulic motor 65 or the arm cylinder 21 alone, pressure oil from the second hydraulic pump P2 and pressure oil from the third hydraulic pump P3 are merged together, and the merged pressure oil is supplied to the PTO hydraulic motor 65 or the arm cylinder 21 to enable speed up of an operation of the external hydraulic work machine 16 or the arm 17.

However, in a case where the external hydraulic work machine 16 is a grass mower, which needs a large amount of working hydraulic oil and works while turning, when the work machine turns during mowing, the amount of oil supply to the PTO decreases, and the number of revolutions of the PTO hydraulic motor 65 decreases. Consequently, grass is not mowed or entangled. When glass is entangled in the blade to increase a rotation load, a relief is actuated so that the machine stops in some cases. To prevent this, as illustrated in FIG. 2, the discharge oil passage 28 of the third hydraulic pump P3 is configured such that oil can be supplied to the turning hydraulic motor 62 through the load check valve 48 and the turning control valve 38 and the discharge oil passage 28 is connected to the PTO control valve 36 through an external pipe 71.

In this manner, in a case where mowing and turning are performed at the same time, that is, in a case where the PTO control valve 36 is switched to the state of supplying oil to the PTO hydraulic motor 65 and, at the same time, the turning control valve 38 comes to be in the state of supplying oil to the turning hydraulic motor 62, pressure oil from third hydraulic pump P3 can be supplied to the turning hydraulic motor 62 to drive the motor for turning and, at the same time, also supplied to the PTO hydraulic motor 65.

Figure 3:
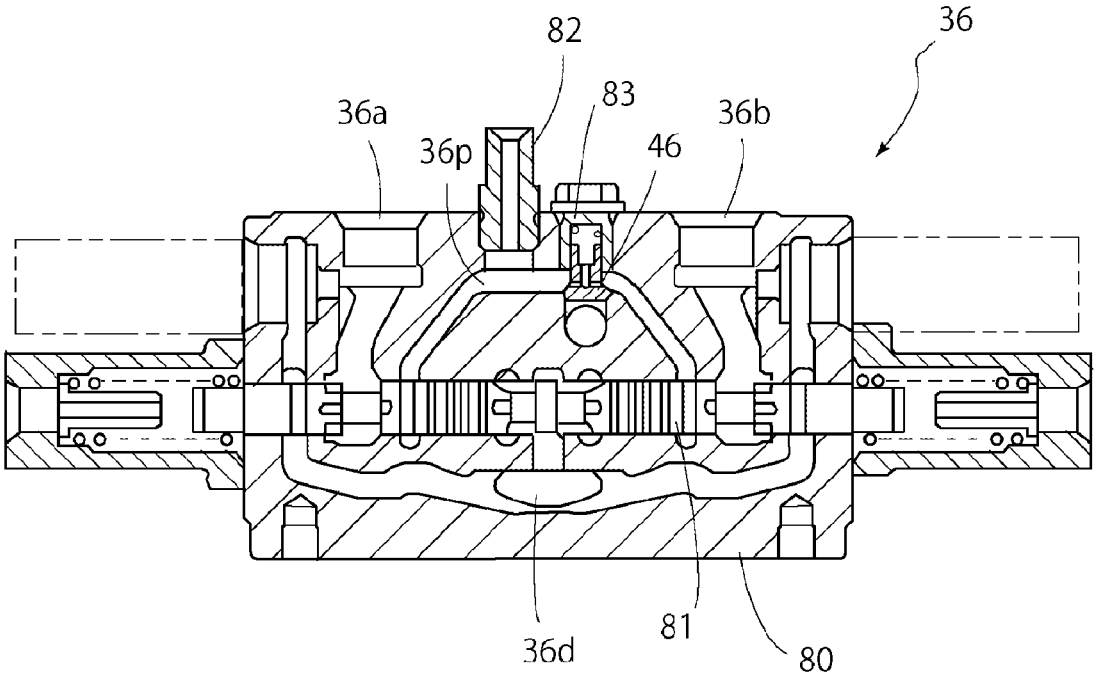
FIG. 3 A cross-sectional view of a PTO control valve.
Figure 4:
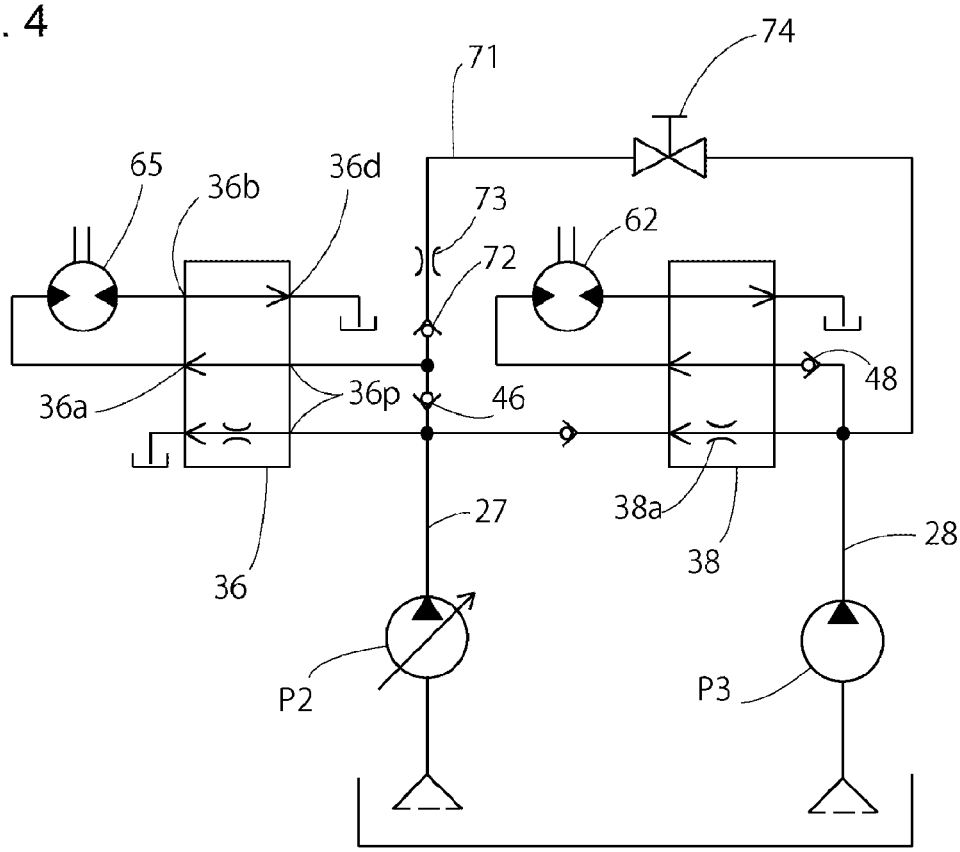
FIG. 4 A hydraulic circuit diagram in a state where the PTO control valve and a control valve for turning are switched to an oil supply state from a hydraulic pump to a hydraulic motor.

That is, as illustrated in FIGS. 3 and 4, in the PTO control valve 36, a spool 81 is slidably housed in a valve case 80, and the spool 81 is caused to slide under a pilot oil pressure from a PTO remote control valve 53 (FIG. 2) so that the PTO control valve 36 is switched. The PTO control valve 36 includes a pump port 36*p*, a drain port 36*d*, and output ports 36*a* and 36*b*. The pump port 36*p* is connected to the discharge oil passage 27 from the second hydraulic pump P2. The drain port 36*d* is connected to an oil passage connected to a hydraulic oil tank. The output ports 36*a* and 36*b* are connected to the PTO hydraulic motor 65 through pipes.

An external pipe 71 is connected to the pump port 36*p*. In this embodiment, as illustrated in FIG. 3, the external pipe 71 has one end directly connected to the pump port 36*p* through a joint pipe 82 of the valve case 80 and another end connected to a discharge oil passage of another pump. In this embodiment, the end is connected to the discharge oil passage 28 of the third hydraulic pump P3.

A check valve 72 serving as a second load check valve for preventing backflow is disposed on an intermediate portion of the external pipe 71 and has a secondary side connected between the pump port 36*p* and the load check valve 46. In this manner, an excessive increase of the turning speed due to backflow of pressure oil from the third hydraulic pump P3 does not occur, and thus, a decrease of the speed of PTO work can be prevented.

A throttle 73 is disposed on an intermediate portion of the external pipe 71 so that branching is obtained to allow an optimum amount of hydraulic oil to flow in the turning hydraulic motor 62 and the PTO hydraulic motor 65. The amount of throttling of the throttle 73 is smaller than the amount of throttling of a throttle formed in the turning control valve 38. That is, oil more easily flows into the throttle 73. The throttle 73 may be a variable throttle so that the amount of throttling can be adjusted to an optimum oil amount.

Figure 5:
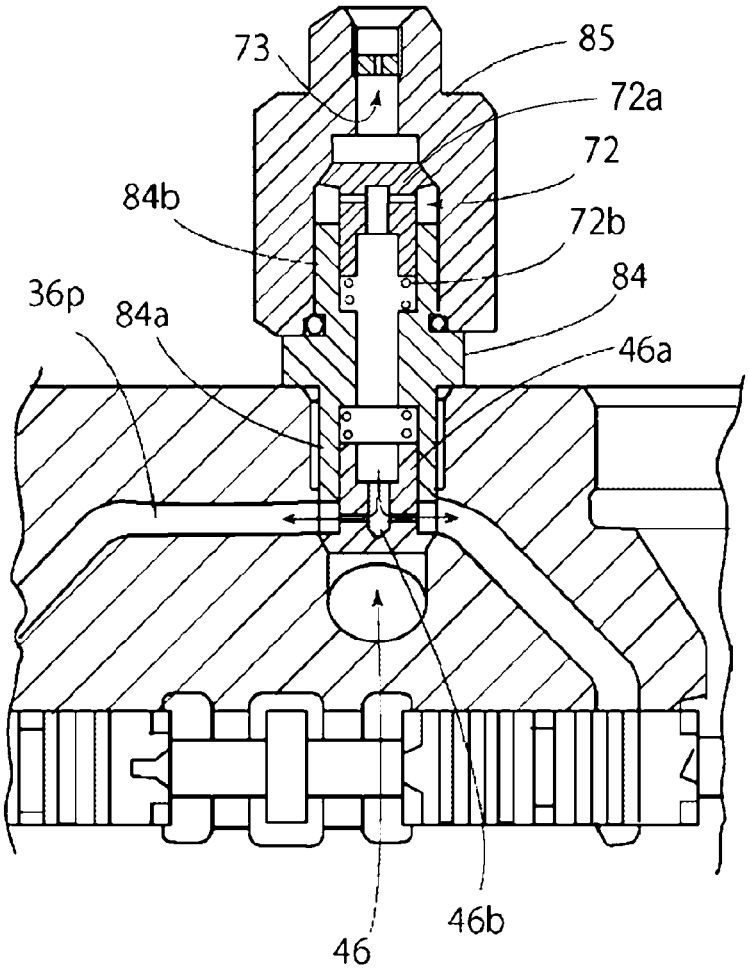
FIG. 5 A cross-sectional view illustrating another embodiment of hydraulic oil supply to the PTO control valve from outside.

A holding plug for holding the load check valve 46 may be used as a joint so that an oil pressure is introduced from the outside. That is, as illustrated in FIG. 3, the load check valve 46 is attached while being held by the holding plug 83. As illustrated in FIG. 5, a communication hole is formed in a shaft center of the holding plug 84 so that an end serves as a holding part 84*a* of the load check valve 46 and an outer periphery of another end serves as a joint part 84*b*.

In this configuration, the holding plug 84 is attached instead of the already provided holding plug 83, and thereby, no processing for additionally attaching the holding plug 83 to the valve case 80 is necessary, and no attachment space for the holding plug 83 is necessary. Accordingly, the size can be reduced, and subsequent attachment can be easily performed.

In addition, a distribution hole 46*b* allowing the pump port 36*p* and the external pipe 71 to communicate with each other may be formed in a valve body 46*a* of the load check valve 46. In this case, the passage can be simplified. Specifically, a hole open to the external pipe 71 and a hole penetrating in the radial direction at the position of the pump port 36*p* are formed to communicate with each other to serve as the distribution hole 46*b*. The valve body 46*a* is biased by a spring to a direction in which the valve is closed to pressure oil from the PTO hydraulic motor 65. In this manner, a passage is formed in the check valve, thereby eliminating the necessity for additional passage. This can achieve size reduction and can reduce the number of parts, resulting in enhancement of reliability.

The check valve 72 may be provided on a joint pipe 85 (or the joint pipe 82) connected to the holding plug 84. Specifically, a valve body 72*a* and a spring 72*b* are housed in the joint pipe 85 for connecting the external pipe 71 to the holding plug 84, and the valve is biased to a direction in which the valve is closed to pressure oil from the PTO hydraulic motor 65. This configuration eliminates the necessity for additionally providing a passage so that size reduction can be achieved, the number of parts can be reduced, and thus, reliability can be enhanced.

In addition, an orifice may be attached to the joint pipe 85 to thereby form the throttle 73. Specifically, a narrow through hole is formed in a spring to allow the side facing the pump port 36*p* and the side facing the external pipe 71 to communicate with each other to form the throttle 73. In this manner, the check valve 72 and the throttle 73 can be integrally formed. Accordingly, size reduction can be achieved, and the number of parts can be reduced so that reliability can be enhanced.

In addition, as illustrated in FIG. 4, a stop valve 74 is provided on an intermediate portion of the external pipe 71. The stop valve 74 can stop supply of pressure oil from the third hydraulic pump P3 to the PTO hydraulic motor 65. For example, in a case where a PTO load is relatively small and work is performed while turning the machine on a sloped ground, the turning speed decreases to reduce working efficiency in some cases. In such cases, to stop merging to the PTO side by closing the stop valve 74 and thereby actuate the turning hydraulic motor 62, pressure oil from the third hydraulic pump P3 is supplied with priority to the turning hydraulic motor 62. In this manner, the stop valve 74 is opened or closed in accordance with a working mode so that the turning hydraulic motor 62 can be efficiently operated.

Figure 6:
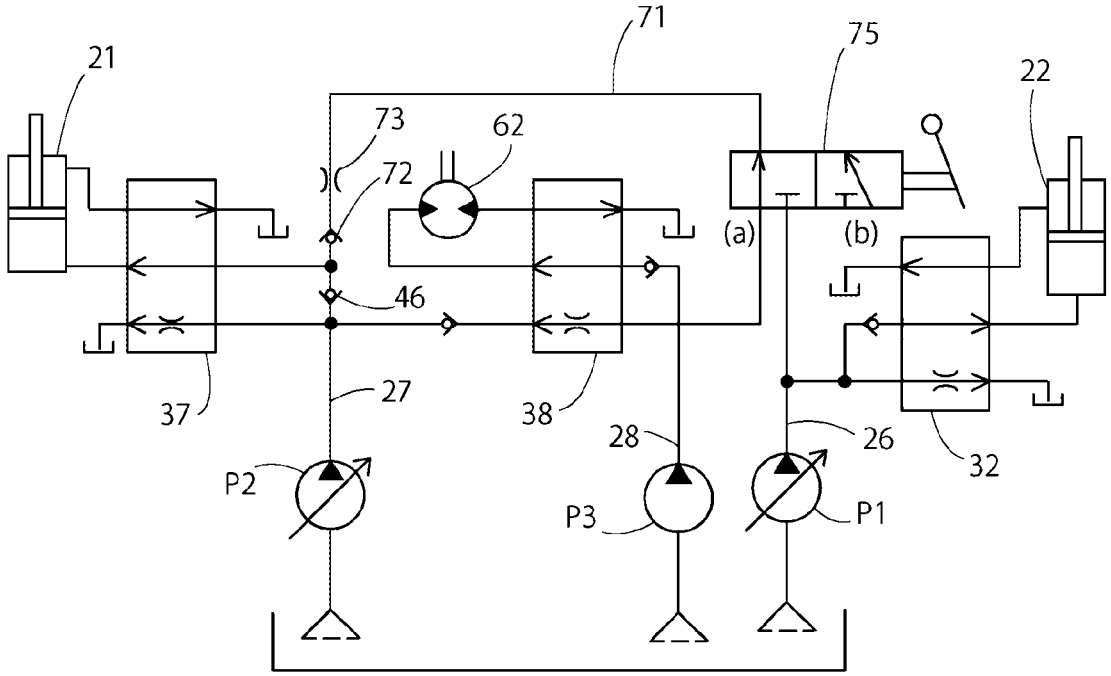
FIG. 6 A hydraulic circuit diagram of an example in which oil supply from a hydraulic pump of an external pipe can be switched in the state where the PTO control valve and the control valve for turning are switched to the oil supply state from the hydraulic pump to the hydraulic motor.

Moreover, as illustrated in FIG. 6, instead of the stop valve 74, a direction control valve 75 may be disposed on the external pipe 71 so that another hydraulic pump can be selected. Specifically, the direction control valve 75 is constituted by a change-over valve having three ports and switchable at two positions, and has a primary side connected to the first hydraulic pump P1 and the third hydraulic pump P3 as other hydraulic pumps and a secondary side connected to the external pipe 71. At a position a, the third hydraulic pump P3 and the external pipe 71 communicate with each other, and the first hydraulic pump P1 is blocked. At a position b, the first hydraulic pump P1 and the external pipe 71 communicate with each other, and the third hydraulic pump P3 is blocked.

In this manner, as described above, in the case of performing mowing while turning the machine, the valve is switched to the position a in performing working. In the case of raising the boom 18 while pulling the arm 17, i.e., in the case of performing PTO work while performing so-called horizontal tow, since a load on the arm 17 is small when the direction control valve 75 is at the position a, hydraulic oil unintentionally flows toward the arm control valve 37 so that the PTO (external hydraulic work machine 16) stops in some cases. In such a case, the direction control valve 75 is switched to the position b to enable supply of pressure oil from the first hydraulic pump P1 as another pump toward the PTO so that horizontal tow, turning, and PTO work can be performed at the same time.

Figure 7:
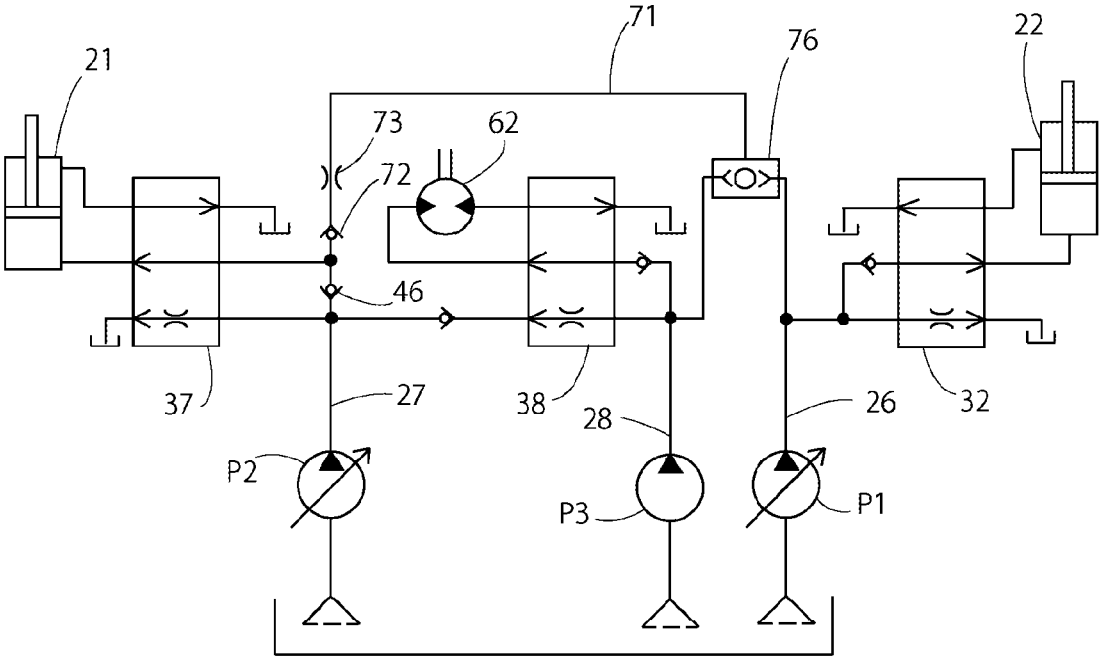
FIG. 7 A hydraulic circuit diagram of an example in which switching of oil supply from the hydraulic pump of the external pipe is automatically performed.

In addition, instead of the direction control valve 75, a shuttle valve 76 may be used. That is, as illustrated in FIG. 7, the third hydraulic pump P3 and the first hydraulic pump P1 as another pump are performed to a primary side of the shuttle valve 76, and the external pipe 71 is connected to the secondary side. In this manner, in a case where the pressure of hydraulic oil supplied from the third hydraulic pump P3 is higher than the pressure of hydraulic oil supplied from the first hydraulic pump P1, the shuttle valve 76 is automatically switched so that part of the hydraulic oil supplied from the third hydraulic pump P3 flows to the external pipe 71 to be supplied toward the PTO. In a case where the pressure of hydraulic oil supplied from the first hydraulic pump P1 is higher than the pressure of hydraulic oil supplied from the third hydraulic pump P3, the shuttle valve 76 is automatically switched so that part of hydraulic oil supplied from the first hydraulic pump P1 flows to the external pipe 71 to be supplied toward the PTO. In this manner, the shuttle valve 76 is automatically selected to a high-pressure side so that an operation of the external hydraulic work machine (PTO) 16 can be stabilized.

As described above, in the hydraulic apparatus for the hydraulic work vehicle that can supply pressure oil to a plurality of hydraulic actuators (the bucket cylinder 20, the arm cylinder 21, the boom cylinder 22, the swing cylinder 25, the blade cylinder 13, the turning hydraulic motor 62, the left traveling hydraulic motor 63, the right traveling hydraulic motor 64, and the PTO hydraulic motor 65) by using at least two hydraulic pumps (the first hydraulic pump P1, the second hydraulic pump P2, and the third hydraulic pump P3), the load check valve 46 is disposed on the oil passage connected to the pump port 36*p* of the PTO control valve 36 for switching oil supply from the second hydraulic pump P2 as one pump to the external hydraulic work machine 16, and pressure oil is branched from the discharge oil passage 28 of the third hydraulic pump P3 as another pump to be supplied to a downstream side (secondary side) of the load check valve 46 through the external pipe 71. Thus, even when the hydraulic actuator (turning motor 2) communicating with the third hydraulic pump P3 as another pump and the external hydraulic work machine 16 are operated at the same time, a predetermined flow rate can be obtained for the hydraulic actuator communicating with the external hydraulic work machine 16 and the third hydraulic pump P3 as another pump. As a result, an extreme decrease of the number of revolutions of the external hydraulic work machine 16 can be avoided.

In addition, since the check valve 72 for preventing backflow is disposed on an intermediate portion of the external hydraulic work machine 16, it is possible to prevent pressure oil to the external hydraulic work machine 16 from flowing toward the hydraulic pump P3 as another pump through the external pipe 71.

Since the throttle 73 is disposed on the external pipe 71, an optimum amount of oil can be allowed to flow toward the external hydraulic work machine 16.

In the foregoing configuration, the holding plug 84 of the load check valve 46 is a joint so that an oil pressure can be introduced from the outside. Thus, the external pipe 71 provided with the load check valve 46 can be connected and easily attached subsequently without replacement of control valves and processing of the valve case. Consequently, the control valve itself does not increase in size.

The load check valve 46 includes the valve body 46*a* in which a passage connecting the external pipe 71 and the pump port 36*p* to each other is formed. Thus, no additional pipe is needed, and the passage can be shortened so that reliability can be enhanced.

Since the check valve 72 for preventing backflow to the external pipe 71 is integrally formed with the holding plug 84 of the load check valve 46, no additional case is necessary for the check valve, and the number of parts can be reduced so that the machine can be made compact. In addition, the orifice is formed in the joint pipe 85 and the shape of the orifice is changed in accordance with the flow rate of the hydraulic apparatus to be attached. This configuration can ease matching.

Furthermore, sine the stop valve 74 is disposed on an intermediate portion of the external pipe 71, the machine can be easily switched between permission and inhibition on whether pressure oil from the hydraulic pump P3 as another pump merges in accordance with a work mode.

In addition, since the direction control valve 75 for selecting a plurality of pumps is disposed on the external pipe 71, it can be selected which one of oil from the hydraulic pump P3 as another pump and oil from the hydraulic pump P1 is to merge in accordance with a work mode, and working efficiency can be increased.

Moreover, since the shuttle valve 76 for selecting a plurality of pumps is disposed on the external pipe 71, the shuttle valve 76 can guide high-pressure hydraulic oil at a high-pressure side in one of the plurality of pumps toward the external pipe 71 so that an operation of the work machine can be stabilized.

INDUSTRIAL APPLICABILITY

The present invention is applicable to a hydraulic apparatus.

REFERENCE SIGNS LIST

P1 first hydraulic pump
P2 second hydraulic pump
P3 third hydraulic pump
16 external hydraulic work machine
36 PTO control valve
46 load check valve
62 turning hydraulic motor
65 PTO hydraulic motor
71 external pipe
72 check valve
73 throttle
74 stop valve
75 direction control valve
76 shuttle valve
84 holding plug

The invention claimed is:

1. A hydraulic apparatus for a hydraulic work vehicle including an external hydraulic work machine, the hydraulic apparatus comprising:
- a plurality of hydraulic pumps;
- a plurality of hydraulic actuators that are supplied with pressure oil from the plurality of hydraulic pumps;
- an external hydraulic actuator that is one of the plurality of hydraulic actuators and configured to actuate the external hydraulic work machine;
- a control valve configured to switch oil supply from a first hydraulic pump of the plurality of hydraulic pumps to the external hydraulic actuator;
- a first load check valve disposed at an input side of the control valve on an oil passage from the first hydraulic pump toward the external hydraulic actuator through the control valve, wherein:
  - the first load check valve is disposed on an oil passage formed in a valve case of the control valve and is attached to the valve case with a holding plug;
  - the holding plug is configured as a joint in order to introduce an oil pressure from outside; and
  - a second load check valve is integrally formed with the holding plug; and
- a pipe connecting a discharge side of a second hydraulic pump of the plurality of hydraulic pumps to a downstream side of the first load check valve.

2. The hydraulic apparatus according to claim 1, wherein:
- a throttle is disposed on the pipe.

3. The hydraulic apparatus according to claim 1, further comprising:
- the holding plug; and
- the second load check valve.

4. The hydraulic apparatus according to claim 1, wherein:
- a channel is formed in a valve body of the first load check valve.

5. The hydraulic apparatus according to claim 1, wherein:
- a stop valve is disposed on the pipe.

6. The hydraulic apparatus according to claim 1, wherein:
- the pipe is provided with a direction control valve configured to select a third hydraulic pump or the second hydraulic pump of the plurality of hydraulic pumps and allow the selected hydraulic pump to communicate with the pipe.

7. The hydraulic apparatus according to claim 1, wherein:

the pipe is provided with a shuttle valve configured to select a third hydraulic pump or the second hydraulic pump of the plurality of hydraulic pumps and allow the selected hydraulic pump to communicate with the pipe.

8. A hydraulic system comprising:

a plurality of hydraulic pumps comprising a first hydraulic pump and a second hydraulic pump;

a hydraulic actuator configured to receive pressure oil from the plurality of hydraulic pumps and actuate a work machine;

a control valve configured to switch oil supply from the first hydraulic pump to the hydraulic actuator, the control valve comprising a valve case;

a holding plug;

a first load check valve attached to the valve case via the holding plug, the first load check valve disposed at an input side of the control valve on an oil passage from the first hydraulic pump toward the hydraulic actuator through the control valve;

a second load check valve is integrally formed with the holding plug; and a pipe connecting a discharge side of the second hydraulic pump to the first load check valve.

9. The hydraulic system of claim 8, further comprising:

a throttle is disposed on the pipe, and a stop valve is disposed on the pipe.

10. A hydraulic system comprising:

a first hydraulic pump;

a second hydraulic pump;

a hydraulic actuator;

a control valve comprising a valve case configured to switch oil supply from the first hydraulic pump to the hydraulic actuator;

a holding plug;

a first load check valve attached to the valve case via the holding plug, the first load check valve disposed at an input side of the control valve on an oil passage from the first hydraulic pump towards the hydraulic actuator through the control valve;

a second load check valve positioned on the holding plug; and a pipe coupling a discharge side of the second hydraulic pump to the first load check valve.

11. The hydraulic system of claim 10, wherein the pipe couples the discharge side of the second hydraulic pump to a downstream side of the first load check valve.

12. The hydraulic system of claim 10, wherein the hydraulic actuator is configured to actuate a work machine.

13. The hydraulic system of claim 10, further comprising a work vehicle.

14. The hydraulic system of claim 13, wherein the work vehicle includes the first hydraulic pump, the second hydraulic pump, the hydraulic actuator, the control valve, the holding plug, the first load check valve, the second load check valve, the pipe, or a combination thereof.

15. The hydraulic system of claim 13, wherein the work vehicle is configured to be coupled to a work machine, the work machine configured to be actuated by the hydraulic actuator.

16. The hydraulic system of claim 10, further comprising a plurality of hydraulic pumps including the first hydraulic pump and the second hydraulic pump.

17. The hydraulic system of claim 16, wherein the hydraulic actuator is configured to receive pressure oil from the plurality of hydraulic pumps.

18. The hydraulic system of claim 10, wherein a first end of the holding plug is configured to serve as a holding part of the first load check valve.

19. The hydraulic system of claim 18, wherein a second end of the holding plug is configured to serve as a joint.

* * * * *